US009450352B2

(12) United States Patent
Miyawaki

(10) Patent No.: US 9,450,352 B2
(45) Date of Patent: Sep. 20, 2016

(54) COAXIAL CONNECTOR

(71) Applicant: Yazaki Corporation, Minato-ku, Tokyo (JP)

(72) Inventor: Koji Miyawaki, Susono (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/631,938

(22) Filed: Feb. 26, 2015

(65) Prior Publication Data

US 2015/0244085 A1 Aug. 27, 2015

(30) Foreign Application Priority Data

Feb. 27, 2014 (JP) ..... 2014-037148

(51) Int. Cl.
*H01R 24/40* (2011.01)
*H01R 24/44* (2011.01)

(52) U.S. Cl.
CPC ..... *H01R 24/44* (2013.01)

(58) Field of Classification Search
CPC ..... H01R 24/44
USPC ..... 439/578
See application file for complete search history.

(56) References Cited

U.S. PATENT DOCUMENTS 3,295,094 A 12/1966 De Lyon et al.
3,660,805 A * 5/1972 McDonough ..... H01R 9/0518 174/75 C
3,828,298 A * 8/1974 Schumacher ..... H01R 9/0512 174/75 C
5,984,710 A * 11/1999 Kodama ..... H01R 9/053 439/394
7,112,092 B2 9/2006 Vielhaber et al.
2003/0224656 A1* 12/2003 Yoshida ..... H01R 9/0518 439/578
2005/0118866 A1* 6/2005 Abe ..... H01R 13/04 439/578
2005/0282434 A1* 12/2005 Morikawa ..... H01R 9/0518 439/578
2006/0205272 A1* 9/2006 Rodrigues ..... H01R 9/0524 439/585
2010/0221949 A1* 9/2010 Okamoto ..... H01R 4/184 439/585
2012/0164879 A1* 6/2012 Chiu ..... H01R 4/184 439/578

(Continued)

FOREIGN PATENT DOCUMENTS

DE 2263777 A1 7/1973
FR 2166526 A5 8/1973
JP 2011-124136 A 6/2011

OTHER PUBLICATIONS

Communication from the German Patent Office dated Jun. 28, 2016 in a counterpart German application No. 10 2015 203 439.9.

*Primary Examiner* — Abdullah Riyami
*Assistant Examiner* — Nelson R Burgos-Guntin
(74) *Attorney, Agent, or Firm* — Sughrue Mion, PLLC

(57) ABSTRACT

A coaxial connector includes an inner conductor terminal connected to a core wire of a coaxial cable, a dielectric body that surrounds an outer periphery of the inner conductor terminal, and an outer conductor terminal connected to a shield conductor of the coaxial cable and having a tubular portion surrounding the inner conductor terminal through the dielectric body. A protruding portion protruding toward an inside of the tubular portion and engaged with the dielectric body to thereby restrict a position of the dielectric body is provided integrally with the tubular portion of the outer conductor terminal. The outer conductor terminal is formed by a stereoscopic shaping method to thereby provide the protruding portion in a protruding condition integrally with an inner peripheral wall of the tubular portion.

6 Claims, 11 Drawing Sheets

(56) References Cited

U.S. PATENT DOCUMENTS

2013/0171873 A1* 7/2013 Kanda ..... H01R 13/6581
439/607.51

2013/0224997 A1* 8/2013 Miyawaki ..... H01R 4/184
439/585

2015/0244085 A1* 8/2015 Miyawaki ..... H01R 24/44
439/578

* cited by examiner

COAXIAL CONNECTOR

BACKGROUND

The present invention relates to a coaxial connector having an inner conductor terminal, a dielectric body and an outer conductor terminal.

A coaxial cable used for high-frequency signal transmission such as an antenna wire generally has, in order from the center toward the outside, a core wire as the center conductor, an insulator as the dielectric body covering the outer periphery of the core wire, a shield conductor (braid, etc.) as the outer conductor covering the outer periphery of the dielectric body and a sheath (referred to also as an insulating sheath) covering the outer peripheral of the shield conductor.

To the terminal portion of the coaxial cable having such a structure, a coaxial connector is attached for connection to a counterpart device, coaxial cable or the like. The coaxial connector has an inner conductor terminal for connecting the core wire to the center conductor (inner conductor terminal) of the counterpart coaxial connector, an outer conductor terminal that earth-connects the shield conductor as the outer conductor to the counterpart coaxial connector to cut off electric noise such as an electromagnetic wave and static electricity, and a dielectric body (insulator) interposed between the inner conductor terminal and the outer conductor terminal.

FIG. 12 shows the structure of a female-side coaxial connector described in JP-A-2011-124136.

A coaxial cable W has, in order from the center toward the outside, a core wire Wa, an insulator Wb covering the outer periphery of the core wire Wa, a shield conductor (braid, etc.) Wc covering the outer periphery of the insulator Wb and a sheath Wd covering the outer periphery of the shield conductor Wc, and a coaxial connector 1 is connected to the terminal portion of the coaxial cable W.

In connecting the coaxial connector 1 to the coaxial cable W, on the terminal portion of the coaxial cable W, a core wire exposed part WA where the sheath Wd, the shield conductor Wc and the insulator Wb are removed so that the core wire Wa is exposed, an insulator exposed part WB where the sheath Wd and the shield conductor Wc are removed so that the insulator Wb is exposed, and a shield conductor exposed part WC where the sheath Wd is removed so that the shield conductor Wc is exposed are formed in order from the end side.

The coaxial connector 1 has an inner conductor terminal 30 connected to the core wire Wa (the core wire exposed part WA) of the coaxial cable W, a dielectric body 20 surrounding the outer periphery of the inner conductor terminal 30, and an outer conductor terminal 10 connected to the shield conductor Wc (the shield conductor exposed part WC) of the coaxial cable W and having a cylindrical portion 11 surrounding the inner conductor terminal 30 through the dielectric body 20. The inner conductor terminal 30 and the outer conductor terminal 10 are generally formed by press-forming a sheet metal.

The inner conductor terminal 30 has at its front part a fitting connection portion 31 to be fitted on the inner conductor terminal of the counterpart coaxial connector, and has at its rear part a core wire connection portion 34 connected to the core wire Wa (the core wire exposed part WA) of the coaxial cable W by press fitting. The position of the inner conductor terminal 30 is restricted with respect to the dielectric body 20 by engaging a locking piece 32 with a locking hole 22 of the dielectric body 20 in a state of being inserted in a central hole 21 of the dielectric body 20.

The outer conductor terminal 10 has at its front part a cylindrical portion (tubular portion) 11 to be connected to the outer conductor terminal of the counterpart coaxial connector, and has at its rear part a shield press-fit portion 14 press-fitted on the shield conductor We (the shield conductor exposed part WC) of the coaxial cable W through a coupling plate portion 13 and a sheath press-fit portion 15 press-fitted on a certain part of the sheath Wd of the coaxial cable W. In the cylindrical portion 11 of this outer conductor terminal 10, the dielectric body 20 and the inner conductor terminal 30 are accommodated, and a protruding portion 12 convex to the inside and formed on the cylindrical portion 11 of the outer conductor terminal 10 is engaged with a locking concave portion 23 formed on the dielectric body 20, whereby the position of the dielectric body 20 is restricted with respect to the outer conductor terminal 10.

The protruding portion 12 of the outer conductor terminal 10 in this case is formed by stamping a part of the peripheral wall of the cylindrical portion 11 inward by press working, and for this reason, a cut hole (notch) 12*a* is formed in the position where the protruding portion 12 is provided.

When the outer conductor terminal 10 is formed by a press-worked product of a sheet metal, since the cut hole 12*a* when the protruding portion 12 is stamped by pressing is formed in the position where the protruding portion 12 for restricting the position of the dielectric body 20 is provided, the shielding performance of the part is inferior.

Accordingly, an object of the present invention is, with respect to solving the above-mentioned problem, to provide a coaxial connector capable of improving the shielding performance of the outer conductor terminal.

SUMMARY

The above-mentioned object of the present invention is attained by the following structure:

(1) A coaxial connector includes: an inner conductor terminal connected to a core wire of a coaxial cable; a dielectric body that surrounds an outer periphery of the inner conductor terminal; and an outer conductor terminal connected to a shield conductor of the coaxial cable and having a tubular portion surrounding the inner conductor terminal through the dielectric body, wherein a protruding portion protruding toward an inside of the tubular portion and engaged with the dielectric body to thereby restrict a position of the dielectric body is provided integrally with the tubular portion of the outer conductor terminal; and wherein the outer conductor terminal is formed by a stereoscopic shaping method to thereby provide the protruding portion in a protruding condition integrally with an inner peripheral wall of the tubular portion.

(2) The coaxial connector according to the above (1), wherein the protruding portion is formed in a circumferential direction so as to surround more than half of an entire perimeter of the dielectric body.

(3) The coaxial connector according to the above (1) or (2), wherein the dielectric body is formed by the stereoscopic shaping method.

According to the coaxial connector of the structure of the above (1), since the outer conductor terminal is formed by the stereoscopic shaping method, unlike the case where the outer conductor terminal is press-formed, the protruding portion for restricting the position of the dielectric body can be formed without the provision of a cut hole on the cylindrical portion. Consequently, the shielding performance improves in accordance with the absence of a shield omission part (part where the cut hole is present) on the cylindrical portion.

According to the coaxial connector of the structure of the above (2), since the protruding portion restricts the dielectric body from the outer periphery side in an area more than half of the perimeter, the concentricity of the outer conductor terminal and the dielectric body can be enhanced. Consequently, when the coaxial connector is mated with the counterpart coaxial connector, the inner conductor terminal of the counterpart coaxial connector never abuts on the end surface of the dielectric body of the coaxial connector, so that the inner conductor terminals can be mated smoothly.

According to the coaxial connector of the structure of the above (3), by forming the dielectric body by the stereoscopic shaping method, the dielectric body material can be filled in the outer conductor terminal without any space left. Consequently, the characteristic impedance can be matched, and the holding force of the parts of fitting of the dielectric body and the outer conductor terminal can be enhanced.

According to the present invention, since the outer conductor terminal is formed by the stereoscopic shaping method, the shielding performance of the outer conductor terminal can be enhanced.

The present invention has been briefly described above. Further, by reading through the mode for carrying out the invention described below (hereinafter, referred to as "embodiment") with reference to the attached drawings, details of the present invention will be further clarified.

BRIEF DESCRIPTION OF THE DRAWINGS

FIG. 1A is a side cross-sectional view, and FIG. 1B is a front view;

FIG. 7A is a front view of an outer conductor terminal as an element thereof, FIG. 7B is a side cross-sectional view, and FIG. 7C is an external perspective view illustrating the completion condition of the male-side coaxial connector;

FIG. 8A is a front view of an outer conductor terminal as an element thereof, FIG. 8B is a side cross-sectional view, and FIG. 8C is an external perspective view illustrating the completion condition of the female-side coaxial connector;

DETAILED DESCRIPTION OF EXEMPLARY EMBODIMENTS

Hereinafter, embodiments of the present invention will be described with reference to the drawings.

Figure 1A:
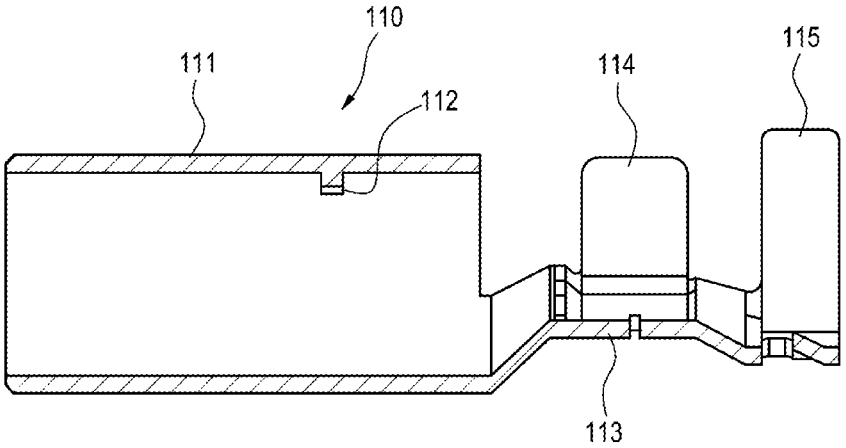
FIGS. 1A and 1B are structural views of an outer conductor terminal as an element of a male-side coaxial connector illustrated as a first embodiment of the present invention.
Figure 1B:
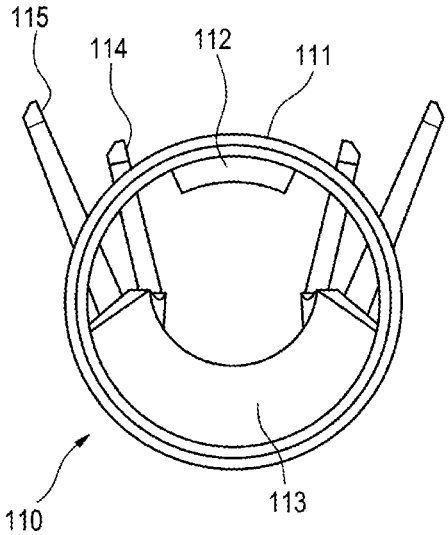
Figure 2:
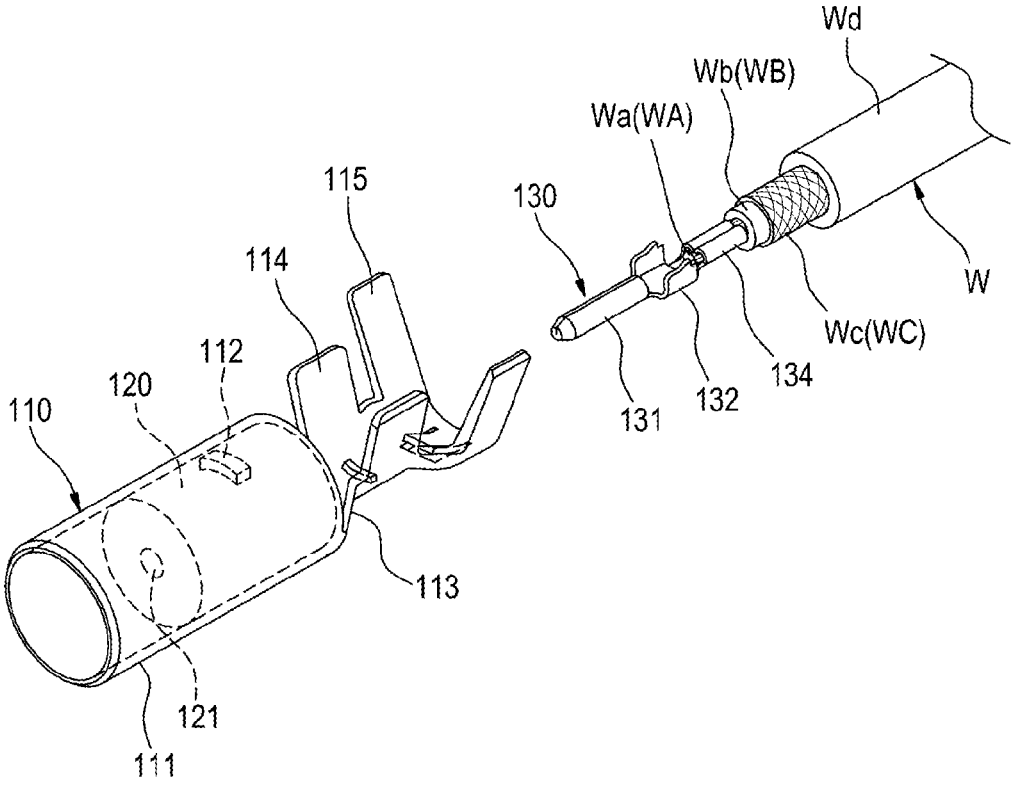
FIG. 2 is a perspective view illustrating a condition where an inner conductor terminal attached to the terminal of a coaxial cable is to be assembled to the outer conductor terminal illustrated in FIG. 1 accommodating a dielectric body.
Figure 3:
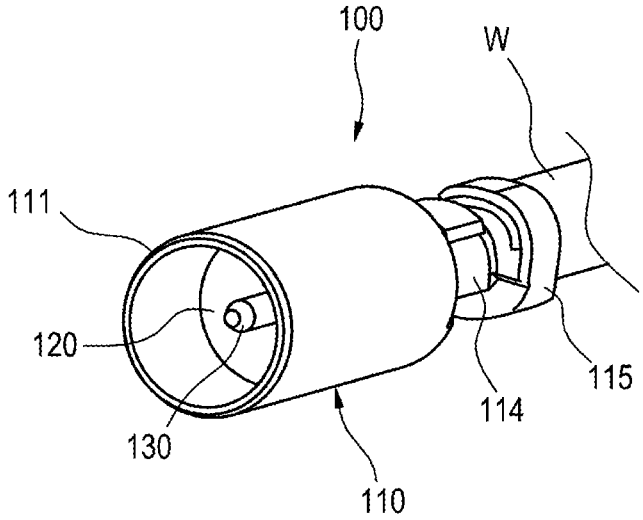
FIG. 3 is an external perspective view illustrating the completion condition of the male-side coaxial connector of the first embodiment.
Figure 4:
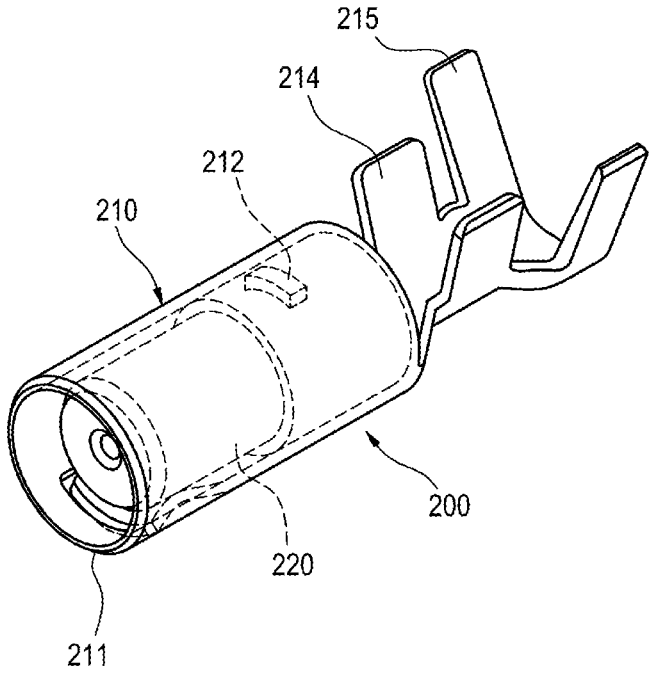
FIG. 4 is a perspective view illustrating the external structure of a female-side coaxial connector of a second embodiment of the present invention.
Figure 5:
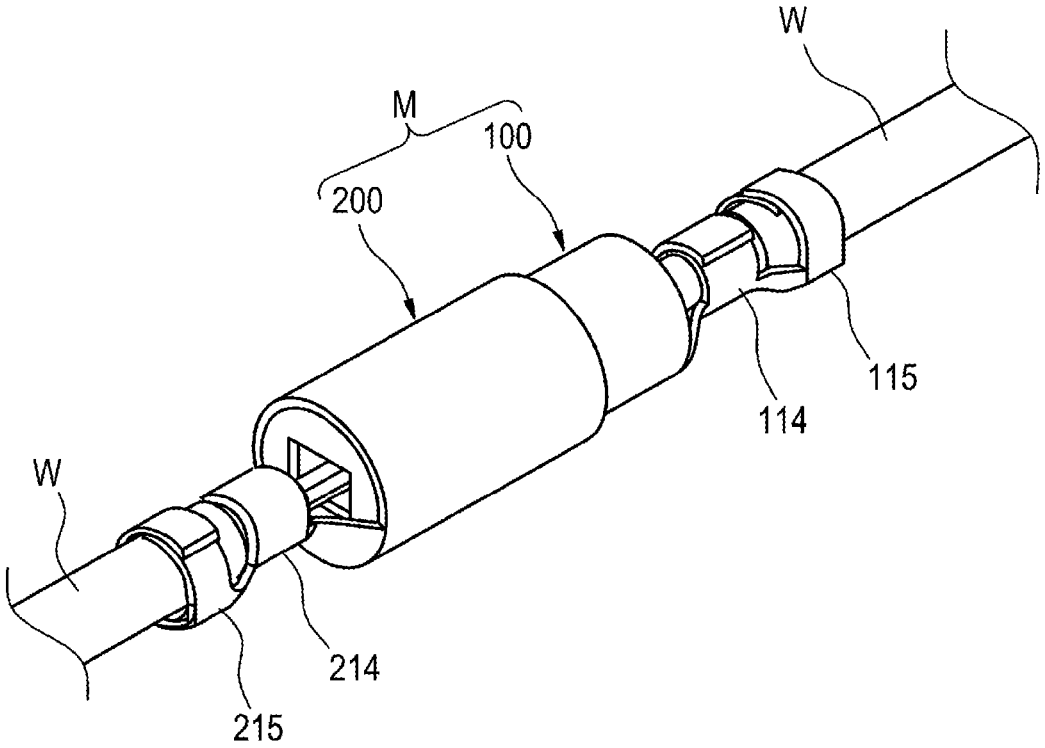
FIG. 5 is a perspective view illustrating the mating condition of a connector device including the male-side coaxial connector of the first embodiment and the female-side coaxial connector of the second embodiment.
Figure 6:
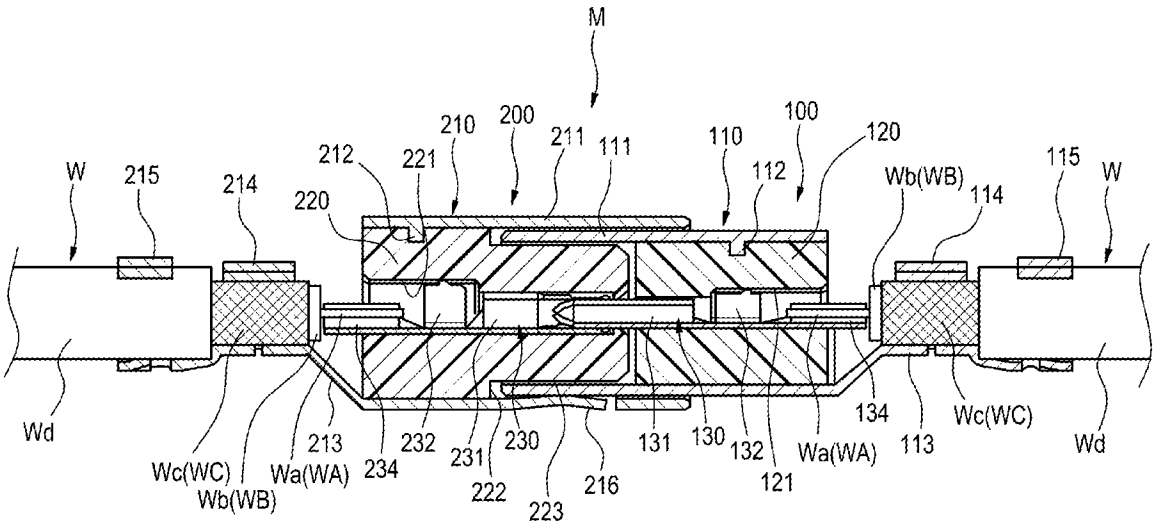
FIG. 6 is a side cross-sectional view illustrating the mating condition of the connector device.

FIGS. 1A and 1B are structural views of an outer conductor terminal as an element of a male-side coaxial connector illustrated as a first embodiment, FIG. 1A is a side cross-sectional view, and FIG. 1B is a front view. FIG. 2 is a perspective view illustrating a condition where an inner conductor terminal attached to the terminal of a coaxial cable is to be assembled to the outer conductor terminal illustrated in FIGS. 1A and 1B accommodating a dielectric body. FIG. 3 is an external perspective view illustrating the completion condition of the coaxial connector of the first embodiment. FIG. 4 is a perspective view illustrating the external structure of a female-side coaxial connector of a second embodiment. FIG. 5 is a perspective view illustrating the mating condition of a connector device including the male-side coaxial connector of the first embodiment and the female-side coaxial connector of the second embodiment. FIG. 6 is a side cross-sectional view illustrating the mating condition of the connector device.

The connector device M illustrated in FIGS. 5 and 6 includes the male-side coaxial connector 100 of the first embodiment and the female-side coaxial connector 200 of the second embodiment connected to the terminal portions of the coaxial cables W on one side and on the other side to be connected together, respectively, and by mating the male-side coaxial connector 100 and the female-side coaxial connector 200 together, the one coaxial cable W and the other coaxial cable W are connected while the shielding performance is maintained.

The coaxial cables W each have, in order from the center toward the outside, a core wire Wa, an insulator Wb covering the outer periphery of the core wire Wa, a shield conductor (braid, etc.) Wc covering the outer periphery of the insulator Wb and a sheath Wd covering the outer periphery of the shield conductor Wc, and the male-side coaxial connector 100 and the female-side coaxial connector 200 are connected to the terminal portions of the coaxial cables W, respectively.

In connecting the coaxial connectors 100 and 200 to the coaxial cables W, on the terminal portion of each coaxial cable W, a core wire exposed part WA where the sheath Wd, the shield conductor Wc and the insulator Wb are removed so that the core wire Wa is exposed, an insulator exposed part WB where the sheath Wd and the shield conductor Wc are removed so that the insulator Wb is exposed, and a shield conductor exposed part WC where the sheath Wd is removed so that the shield conductor Wc is exposed are formed in order from the end side.

The male-side coaxial connector 100 and the female-side coaxial connector 200 have inner conductor terminals 130 and 230 connected to the core wires Wa (the core wire exposed parts WA) of the coaxial cables W, respectively, resin dielectric bodys 120 and 220 surrounding the outer peripheries of the inner conductor terminals 130 and 230, and outer conductor terminals 110 and 210 connected to the shield conductors Wc (the shield conductor exposed parts WC) of the coaxial cables W and having cylindrical portions 111 and 211 surrounding the inner conductor terminals 130 and 230 through the dielectric bodys 120 and 220.

The inner conductor terminals 130 and 230 have at their front parts fitting connection portions 131 and 231 to be fitted on the inner conductor terminal of the counterpart coaxial connector, and have at their rear parts core wire connection portions 134 and 234 connected to the core wires Wa (the core wire exposed parts WA) of the coaxial cables W by press fitting. The positions of the inner conductor terminals 130 and 230 are restricted with respect to the dielectric bodies 120 and 220 by fitting locking protrusions 132 and 232 on the inner walls of central holes 121 and 221 of the dielectric bodies 120 and 220 in a state of being inserted in the central holes 121 and 221.

The outer conductor terminals 110 and 210, as also illustrated in FIGS. 1A to 4, have at their front parts cylindrical portions (tubular portions) 111 and 211 to be connected to the outer conductor terminal of the counterpart coaxial connector, and have at their rear parts shield press-fit portions 114 and 214 press-fitted on the shield conductors We (the shield conductor exposed parts WC) of the coaxial cables W through coupling plate portions 113 and 213 and sheath press-fit portions 115 and 215 press-fitted on certain parts of the sheaths Wd of the coaxial cables W. In the cylindrical portions 111 and 211 of these outer conductor terminals 110 and 210, the dielectric bodies 120 and 220 and the inner conductor terminals 130 and 230 are accommodated, and protruding portions 112 and 212 provided in a protruding condition on the inner periphery of the cylindrical portions 111 and 211 of the outer conductor terminals 110 and 210 are engaged with the dielectric bodies 120 and 220, whereby the positions of the dielectric bodies 120 and 220 are restricted with respect to the outer conductor terminals 110 and 210.

The fitting connection portion 131 of the inner conductor terminal 130 of the male-side coaxial connector 100 is formed in a pin shape, and fitted in the cylindrical fitting connection portion 231 of the inner conductor terminal 230 of the female-side coaxial connector 200 when the connectors are mated together. The cylindrical portion 111 of the outer conductor terminal 110 of the male-side coaxial connector 100 is fitted in the inner periphery of the front half of the cylindrical portion 211 of the outer conductor terminal 210 of the female-side coaxial connector 200, and under that condition, the front half of the cylindrical portion 111 covers the front half of the dielectric body 220 of the female-side coaxial connector 200.

Consequently, between the outer periphery of the front half of the dielectric body 220 and the inner periphery of the front half of the cylindrical portion 211 of the female-side coaxial connector 200, a circumferentially cut portion 222 is formed on the outer periphery of the front half on the side of the dielectric body 220, whereby a gap 223 in which the front half of the cylindrical portion 111 of the outer conductor terminal 110 of the male-side coaxial connector 100 is inserted is secured. In order that the outer conductor terminal 110 of the male-side coaxial connector 100 and the outer conductor terminal 210 of the female-side coaxial connector 200 are not disconnected from each other under the connector mating condition, a locking piece 216 for preventing disconnection is provided on the front half (position overlapping the cylindrical portion 111 of the outer conductor terminal 110 of the male-side coaxial connector 100) of the cylindrical portion 211 of the outer conductor terminal 210 of the female-side coaxial connector 200.

While the inner conductor terminals 130 and 230 are formed by press-forming a sheet metal, at least the cylindrical portions 111 and 211 of the outer conductor terminals 110 and 210 of the coaxial connectors 100 and 200 are formed by stereoscopic shaping method (a three-dimensional modeling method). The stereoscopic shaping method to form the cylindrical portions 111 and 211 means forming a three-dimensional structure by a so-called three-dimensional printer. In the case of the present embodiment, various known printers may be used as the three-dimensional printer.

The stereoscopic shaping method is a method where the three-dimensional shape data of a product is sliced into thin layers on a computer, the cross-sectional shape data of each sliced layer is calculated, thin layers are physically produced in order based on the calculated data and these are laminated and joined together to thereby form the three-dimensional product shape.

The stereoscopic shaping method includes a thermal dissolution lamination method, an optical modeling method, a powder sintering method, an inkjet method, a projection method and an ink-jet powder laminating method, and three-dimensional printers of these methods may be used. In this example, since the material is a metal, the powder sintering method or the ink-jet powder lamination method is effective.

For example, according to the powder sintering method, modeling proceeds in the following order:

(1) First, material powder is thinly spread on a bed for modeling.

(2) Then, the cross-sectional shape of the lowermost layer of the cross-sectional shapes is drawn by laser, an electronic beam, an ultraviolet ray or the like, and the powder of the drawn part is sintered.

(3) After the cross section of the lowermost layer is sintered, the bed is lowered by the height equal to the slice distance, and the material powder is spread on the bed with a small thickness equal to the slice interval.

(4) Then, the cross-sectional shape of the layer immediately above the previously formed cross section is again drawn by laser and sintered.

(5) By repeating this, a three-dimensional object is modeled.

According to the ink-jet powder laminating method, the material powder is jetted in the manner of an ink-jet printer, laser, an ultraviolet ray, heat or the like is added to the material powder so that it is sintered, and lamination and sintering of a thin layer are repeated, whereby one three-dimensional object is modeled.

When the cylindrical portions 111 and 211 of the outer conductor terminals 110 and 210 are formed by the stereoscopic shaping method, the protruding portions 112 and 212 provided in a protruding condition on the inner periphery of the cylindrical portions 111 and 211 and engaged with the dielectric bodies can be formed integrally with the inner peripheries of the peripheral walls without the provision of cut holes as in the case of press working on the peripheral walls of the cylindrical portions 111 and 211. The protruding portions 112 and 212 in this case are for restricting the positions of the dielectric bodies 120 and 220 in the front-back direction and in the circumferential direction when the outer conductor terminals 110 and 210 and the dielectric bodies 120 and 220 are combined, and are formed as protrusions of an appropriate length in the circumferential direction.

To assemble the coaxial connectors 100 and 200 on the male side and the female side by combining the outer conductor terminals 110 and 210, the dielectric bodies 120 and 220 and the inner conductor terminals 130 and 230 structured as described above, as the case of the male side is illustrated in FIG. 2 as a representative example, the fitting connection portion 131 (231) of the inner conductor terminal 130 (230) connected to the terminal portion of the coaxial cable W is inserted into the central hole 121 of the dielectric body 120 (220) under a condition where the dielectric body 120 (220) is accommodated in the outer conductor terminal 110 (210). Then, after the inner conductor terminal 130 (230) is inserted, the shield press-fit portion 114 (214) of the outer conductor terminal 110 (210) is press-fitted on the shield conductor We (the shield conductor exposed part WC) of the coaxial cable W, and the sheath press-fit portion 115 (215) is press-fitted on a certain part of the sheath Wd of the coaxial cable W. Thereby, the male-side coaxial connector 100 and the female-side coaxial connector 200 illustrated in FIGS. 3 and 4 are completed.

As a method of combining the dielectric bodies 120 and 220 and the outer conductor terminals 110 and 210, the following methods are considered: a method where the outer conductor terminals 110 and 210 are formed by the stereoscopic shaping method first and then, the dielectric bodies 120 and 220 are fitted; and a method where they are molded by insert-molding. It is also considered to form the dielectric bodies 120 and 220 by the stereoscopic shaping method.

It is also considered to form the dielectric bodies 120 and 220 on the inner conductor terminals 130 and 230 by the stereoscopic shaping method (or form them by a method other than the stereoscopic shaping method and fit them) first and then, form the entire parts of the outer conductor terminals 110 and 210 by the stereoscopic shaping method.

According to the coaxial connectors 100 and 200 structured as described above, since the outer conductor terminals 110 and 210 are formed by the stereoscopic shaping method, unlike the case where the outer conductor terminals 110 and 210 are press-formed, the protruding portions 112 and 212 for restricting the positions of the dielectric bodies 120 and 220 can be formed without the provision of cut holes on the cylindrical portions 111 and 211. Consequently, the shielding performance improves in accordance with the absence of shield omission parts (parts where the cut holes are present) on the cylindrical portions 111 and 211.

Moreover, when the dielectric bodies 120 and 220 are formed by the stereoscopic shaping method, since the dielectric material can be filled in the outer conductor terminals 110 and 210 without any space left, the characteristic impedance can be matched, and the holding force of the parts of fitting of the dielectric bodies 120 and 220 and the outer conductor terminals 110 and 210 can be enhanced.

Next, other embodiments will be described.

Figure 7A:
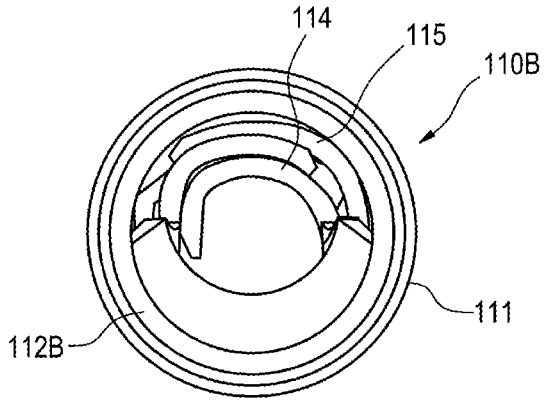
FIGS. 7A to 7C are explanatory views of a male-side coaxial connector illustrated as a third embodiment of the present invention.
Figure 7B:
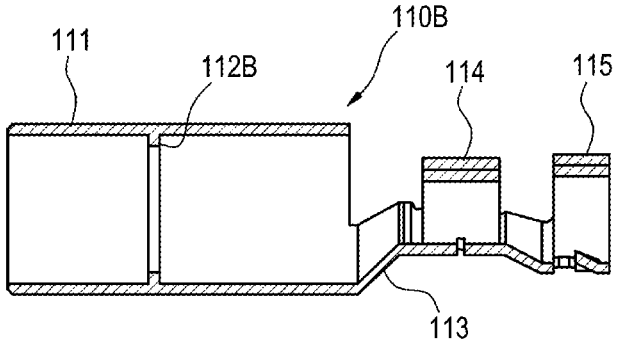
Figure 7C:
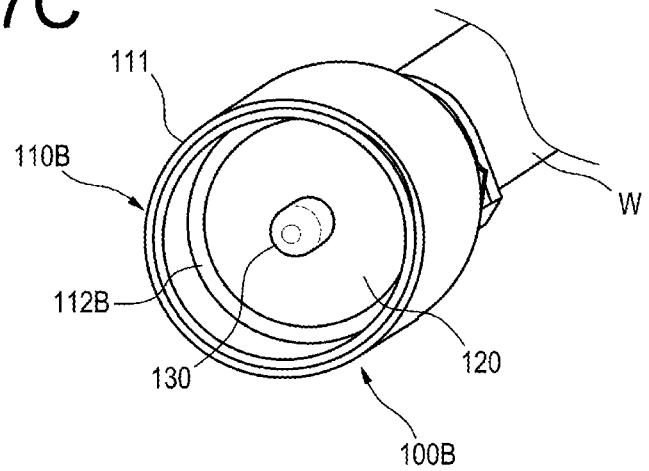
Figure 8A:
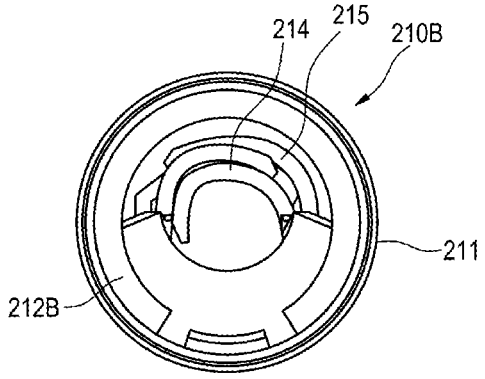
FIGS. 8A to 8C are explanatory views of a female-side coaxial connector illustrated as a fourth embodiment of the present invention.
Figure 8B:
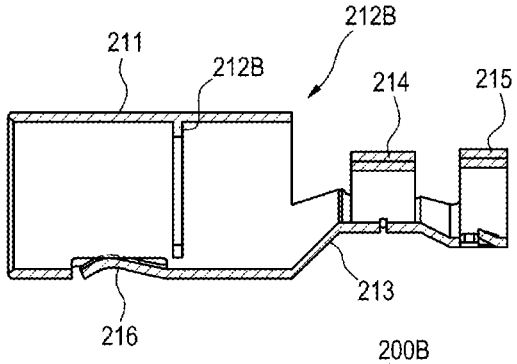
Figure 8C:
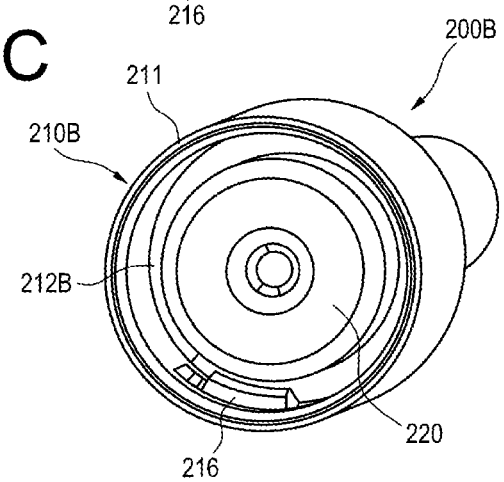
Figure 9:
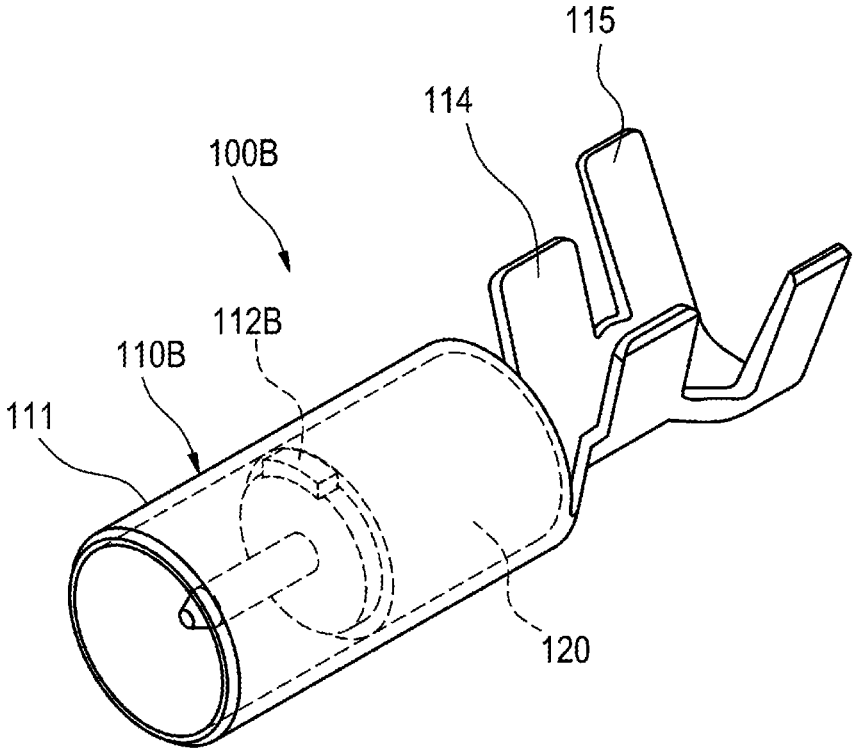
FIG. 9 is an external perspective view illustrating the completion condition of the male-side coaxial connector of the third embodiment.
Figure 10:
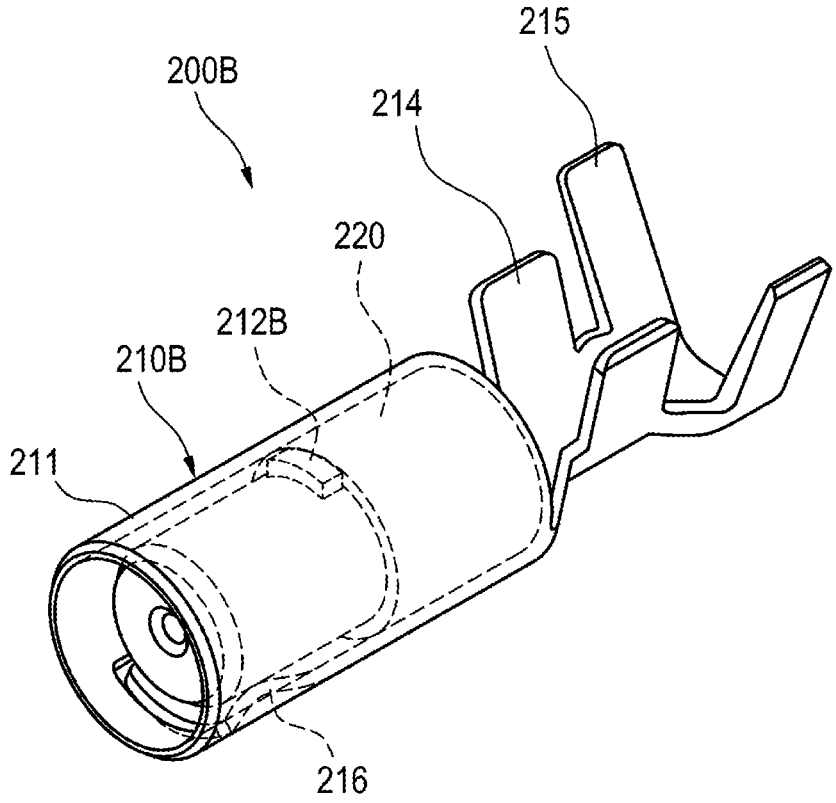
FIG. 10 is an external perspective view illustrating the completion condition of the female-side coaxial connector of the fourth embodiment.
Figure 11:
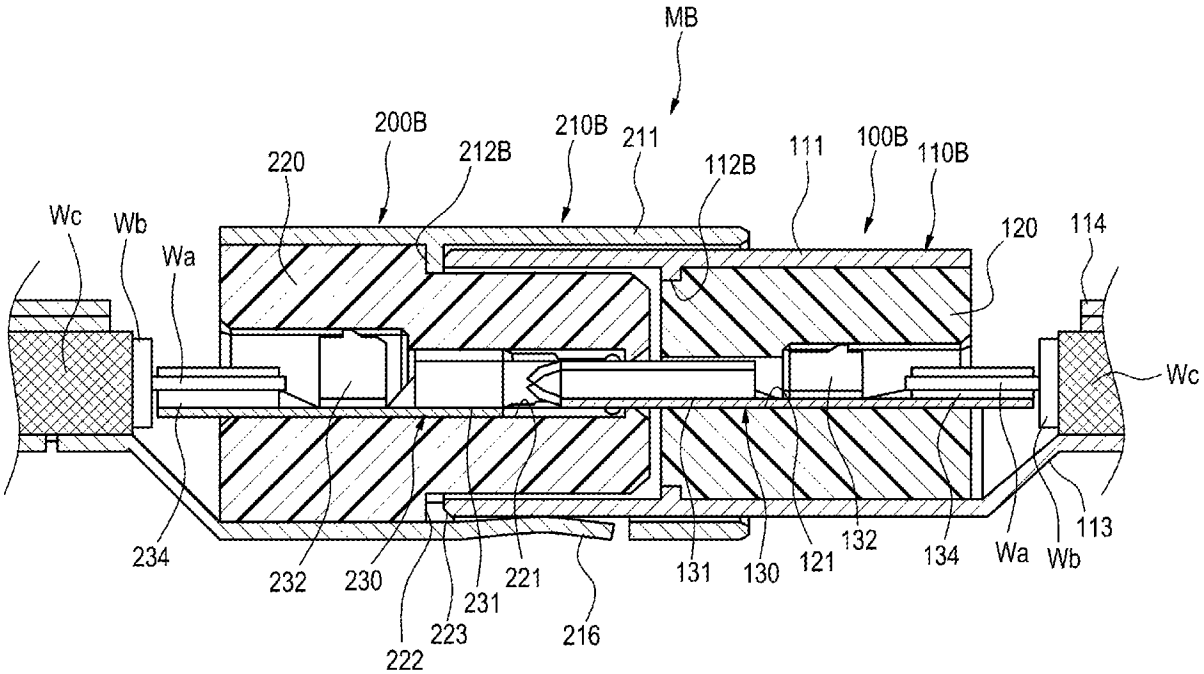
FIG. 11 is a side cross-sectional view illustrating the mating condition of a connector device including the male-side coaxial connector of the third embodiment and the female-side coaxial connector of the fourth embodiment.
Figure 12:
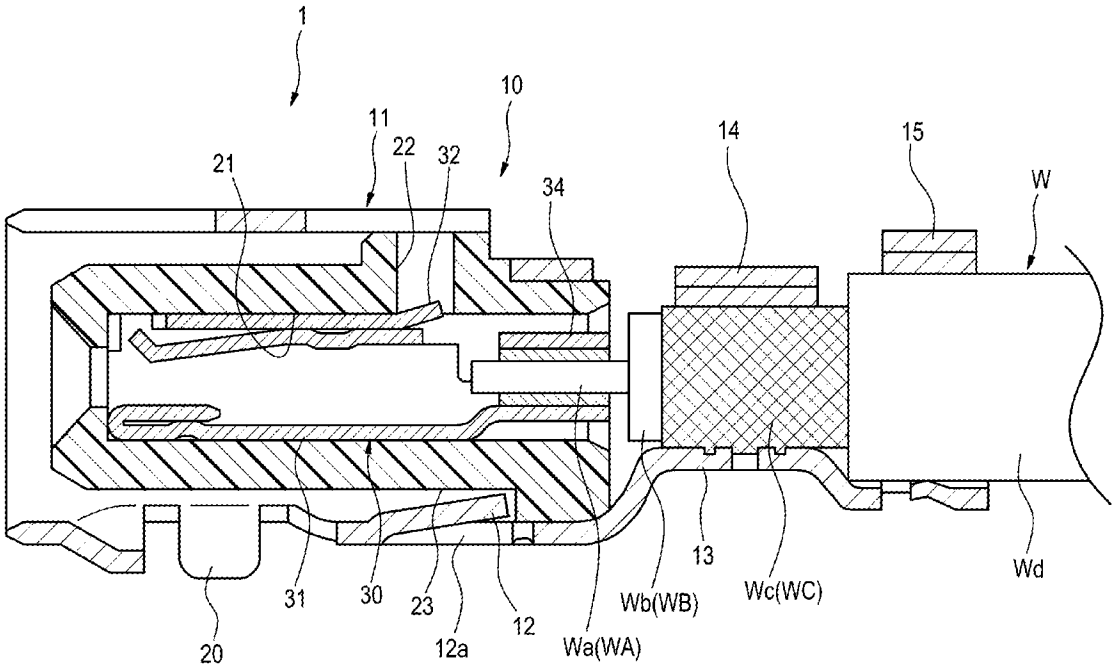
FIG. 12 is a side cross-sectional view illustrating the structure of the conventional female-side coaxial connector.

FIGS. 7A to 7C are explanatory views of a male-side coaxial connector illustrated as a third embodiment, FIG. 7A is a front view of an outer conductor terminal as an element thereof, FIG. 7B is a side cross-sectional view, and FIG. 7C is an external perspective view illustrating the completion condition of the male-side coaxial connector. FIGS. 8A to 8C are explanatory views of a female-side coaxial connector illustrated as a fourth embodiment, FIG. 8A is a front view of an outer conductor terminal as an element thereof, FIG. 8B is a side cross-sectional view, and FIG. 8C is an external perspective view illustrating the completion condition of the female-side coaxial connector. FIG. 9 is an external perspective view illustrating the completion condition of the male-side coaxial connector of the third embodiment. FIG. 10 is an external perspective view illustrating the completion condition of the female-side coaxial connector of the fourth embodiment. FIG. 11 is a side cross-sectional view illustrating the mating condition of a connector device including the male-side coaxial connector of the third embodiment and the female-side coaxial connector of the fourth embodiment.

The connector device MB illustrated in FIG. 11 includes the male-side coaxial connector 100B of the third embodiment and the female-side coaxial connector 200B of the fourth embodiment connected to the terminal portions of the coaxial cables W on one side and on the other side to be connected together, respectively, and by mating the male-side coaxial connector 100B and the female-side coaxial connector 200B together, the one coaxial cable W and the other coaxial cable W are connected while the shielding performance is maintained.

Since the male-side coaxial connector 100B and the female-side coaxial connector 200B of this connector device MB have similar basic structures as those of the male-side coaxial connector 100 and the female-side coaxial connector 200 of the first and second embodiments illustrated in FIG. 6, the same elements are denoted by the same reference numerals, descriptions thereof are omitted, and only different parts will be described below.

On outer conductor terminals 110B and 210B of the male-side coaxial connector 100B and the female-side coaxial connector 200B, at least the cylindrical portions 111 and 211 are formed by the stereoscopic shaping method, respectively, and as also illustrated in FIGS. 7A to 8C, on the inner peripheries of the cylindrical portions 111 and 211, protruding portions 112B and 212B for restricting the positions of the dielectric bodies 120 and 220 in the front-back direction and in the circumferential direction are provided.

The protruding portions 112B and 212B in this case are continuously formed in the circumferential direction so as to surround more than half of the entire perimeters of the dielectric bodies 120 and 220. On the outer conductor terminal 110B of the male-side coaxial connector 100B, as illustrated in FIGS. 7A to 7C and FIG. 9, the protruding portion 112B is formed as a 360-degree flange so as to surround the entire perimeter of the dielectric body 120. On the outer conductor terminal 210B of the female-side coaxial connector 200B, as illustrated in FIG. 8A to 8C and FIG. 10, the protruding portion 212B is formed as a partially cut-off arc-shaped flange so as to surround an area of a predetermined angle more than half of the entire perimeter of the dielectric body 220.

These protruding portion 112B and 212B are, as illustrated in FIG. 11, situated at the front end of the dielectric body 120 in the case of the male side and situated at the step portion of the circumferentially cut portion 222 of the dielectric body 220 in the case of the female side. In particular, in the case where the protruding portion 212B of the outer conductor terminal 110B is situated at the step portion of the circumferentially cut portion 222 of the dielectric body 220 like the female-side coaxial connector 200B, when the connectors are mated together, the end of the cylindrical portion 111 of the outer conductor terminal 110 of the male-side coaxial connector 100B abuts on the protruding portion 212B, whereby the insertion position of the male-side coaxial connector 100B can be restricted by the protruding portion 212B.

When the protruding portions 112B and 212B are formed as described above, since the protruding portions 112B and 212B restrict the dielectric bodies 120 and 220 from the outer periphery side in an area more than half of the perimeter, the concentricity of the outer conductor terminals 110 and 210 and the dielectric bodies 120 and 220 can be enhanced. Consequently, when the coaxial connectors 100B and 200B are mated together, the end of the inner conductor terminal 130 of the male-side coaxial connector 100B never abuts on the end surface of the dielectric body 220 of the female-side coaxial connector 200B, so that the inner conductor terminals 130 and 230 can be mated smoothly.

The present invention is not limited to the above-described embodiments, and modifications, improvements and the like are possible as appropriate. Besides, the materials, shapes, dimensions, numbers, disposition positions and the like of the elements of the above-described embodiments are arbitrary as long as the present invention is attained, and are not limited.

For example, while the tubular portions are formed as the cylindrical portions 111 and 121 in the above-described embodiments, they may be formed as elliptic cylinders or may be formed as square pillars.

Now, features of the above-described embodiments of the coaxial connector according to the present invention are briefly summarized and listed in the following [1] to [3]:

[1] A coaxial connector (100, 200, 100B, 200B) includes: an inner conductor terminal (130, 230) connected to a core wire (Wa) of a coaxial cable (W); a dielectric body (120, 220) that surrounds an outer periphery of the inner conductor terminal (130, 230); and an outer conductor terminal (110, 210, 110B, 210B) connected to a shield conductor (Wc) of the coaxial cable (W) and having a tubular portion (111, 211) surrounding the inner conductor terminal (130, 230) through the dielectric body (120, 220), and wherein a protruding portion (112, 212, 112B, 212B) protruding toward an inside of the tubular portion (111, 211) and engaged with the dielectric body (120, 220) to thereby restrict a position of the dielectric body (120, 220) is provided integrally with the tubular portion (111, 211) of the outer conductor terminal (110, 210, 110B, 210B); and wherein the outer conductor terminal (110, 210, 110B, 210B) is formed by a stereoscopic shaping method to thereby provide the protruding portion (112, 212, 112B, 212B) in a protruding condition integrally with an inner peripheral wall of the tubular portion (111, 211).

[2] The coaxial connector (100B, 200B) according to the above [1], wherein the protruding portion (112B, 212B) is formed in a circumferential direction so as to surround more than half of an entire perimeter of the dielectric body (120, 220).

[3] The coaxial connector (100, 200, 100B, 200B) according to the above [1] or [2], wherein the dielectric body (120, 220) is formed by the stereoscopic shaping method.

Although the invention has been illustrated and described for the particular preferred embodiments, it is apparent to a person skilled in the art that various changes and modifications can be made on the basis of the teachings of the invention. It is apparent that such changes and modifications are within the spirit, scope, and intention of the invention as defined by the appended claims.

The present application is based on Japanese Patent Application No. 2014-037148 filed on Feb. 27, 2014, the contents of which are incorporated herein by reference.

What is claimed is:

1. A coaxial connector comprising:

an inner conductor terminal connected to a core wire of a coaxial cable;

a dielectric body that surrounds an outer periphery of the inner conductor terminal; and an outer conductor terminal connected to a shield conductor of the coaxial cable and having a tubular portion which has a continuous outer surface and surrounds the inner conductor terminal through the dielectric body, wherein a protruding portion protruding from an inner peripheral wall of the tubular portion toward an inside of the tubular portion and engaged with the dielectric body to thereby restrict a position of the dielectric body is integrally formed with the tubular portion of the outer conductor terminal.

2. The coaxial connector according to claim 1, wherein the protruding portion is formed in a circumferential direction so as to surround more than half of an entire perimeter of the dielectric body.

3. The coaxial connector according to claim 1, wherein the dielectric body is formed by a stereoscopic shaping method.

4. A method for manufacturing a coaxial connector, comprising:

preparing an inner conductor terminal configured to be connected to a core wire of a coaxial cable;

forming a dielectric body that surrounds an outer periphery of the inner conductor terminal;

forming an outer conductor terminal, configured to be connected to a shield conductor of the coaxial cable, and having a tubular portion which surrounds the inner conductor terminal through the dielectric body and a protruding portion which protrudes integrally from an inner peripheral wall of the tubular portion toward an inside of the tubular portion, by a stereoscopic shaping method, wherein the protruding portion is configured to be engaged with the dielectric body to thereby restrict a position of the dielectric body.

5. The method according to claim 4, wherein the protruding portion extends in a circumferential direction of the tubular portion so as to surround more than half of an entire perimeter of the dielectric body.

6. The method according to claim 4, wherein the dielectric body is formed by the stereoscopic shaping method.

* * * * *